United States Patent [19]

Kawasumi et al.

[11] 4,028,870

[45] June 14, 1977

[54] METHOD AND DEVICE FOR PREVENTING CREATION OF FUZZY FIBERS OF YARN DURING TWISTING OPERATION OF THE MULTIPLE TWISTER

[75] Inventors: Nobumitsu Kawasumi, Nagoya; Shigeru Muramatsu, Okazaki; Mamoru Suzuki, Aichi; Yoshiharu Yasui, Kariya, all of Japan

[73] Assignee: Kabushiki Kaisha Toyoda Jidoshokki Seisakusho, Japan

[22] Filed: Aug. 4, 1975

[21] Appl. No.: 601,300

[30] Foreign Application Priority Data

| | | |
|---|---|---|
| Aug. 3, 1974 | Japan | 49-89309 |
| Dec. 27, 1974 | Japan | 49-3645 |
| Dec. 28, 1974 | Japan | 49-2078 |

[52] U.S. Cl. ..... 57/58.84; 28/67; 57/35; 57/58.86; 57/164

[51] Int. Cl.[2] ..... D01H 7/86

[58] Field of Search ..... 57/35, 58.49, 58.59, 57/58.7, 58.83, 58.84, 58.86, 106, 156, 164; 28/67

[56] References Cited

UNITED STATES PATENTS

| | | | |
|---|---|---|---|
| 2,811,013 | 10/1957 | Klein | 57/58.84 X |
| 3,295,305 | 1/1967 | Nintz | 57/58.49 |
| 3,410,071 | 11/1968 | Heimes | 57/58.86 X |
| 3,490,221 | 1/1970 | Heimes et al. | 57/58.86 |
| 3,864,901 | 2/1975 | Beymes et al. | 57/58.83 X |

*Primary Examiner*—Richard C. Queisser
*Assistant Examiner*—Charles Gorenstein
*Attorney, Agent, or Firm*—Burgess Ryan and Wayne

[57] ABSTRACT

In a multiple twister provided with at least a first twisting mechanism and a second twisting mechanism successively arranged, when a yarn supplied from a yarn package held in said multiple twister contacts component elements of the twister, there is a tendency of creating fuzzy fibers projecting from the main body of the yarn. Such fuzzy fibers are laid down against the main body of the supplied yarn by contacting a contacting member disposed at an upstream terminal of a first twisting yarn passage formed in the first twisting mechanism and/or stroked against the main body of the first twisted yarn by contacting a friction surface particularly formed in a yarn guide disposed at a downstream terminal of a second twisting yarn passage formed in the second twisting mechanism so that the laid down fuzzy fibers are twisted into the main body of the yarn.

18 Claims, 43 Drawing Figures

METHOD AND DEVICE FOR PREVENTING CREATION OF FUZZY FIBERS OF YARN DURING TWISTING OPERATION OF THE MULTIPLE TWISTER

SUMMARY OF THE INVENTION

The present invention relates toa method and device for preventing creation of fuzzy fibers of yarn during twisting operation in the multiple twister, more particularly in the double twister.

In the conventional double twister, wherein a hollow spindle is provided with a reserve disc disposed at a position between a spindle wharve and thereof, and a protection pot is coaxially mounted on the spindle via bearing means in such a condition that a supporting cylindrical portion formed therein is mounted on the spindle in such a condition that it is capable of stationary positioning during driving of the spindle, a hollow entry tube is stationarily mounted on the supporting cylindrical portion and the hollow entry tube extends upwards along the axial direction of the spindle; the reserve disc is provided with a yarn guide passage radially extending from the center thereof and the yarn guide passage is connected to a bottom aperture of the hollow spindle, a yarn taken from a yarn package held by the protection pot is introduced into the entry tube via a guide bush stationarily mounted on the top end of the entry tube, then the yarn is led toward the yarn guide passage of the reserve disc which is rotating with the spindle, thereafter the yarn is taken from an outlet of the yarn guide passage and led to a yarn guide stationarily disposed above the hollow yarn guide bush along an extended line of the common longitudinal axis of the entry tube and the spindle, and; finally the twisted yarn is wound on a package. During the above-mentioned twisting operation, when the yarn introduced into the hollow entry tube, is led to a tip of the hollow spindle, the yarn passes through an intermediate member disposed between the entry tube and the spindle so as to control the yarn tension. When the yarn taken from the yarn guide passage of the reserve disc is led to the hollow yarn guide disposed above the entry tube, the yarn passes at least one time through a yarn passage formed on the entire peripheral surface of the tension disc so as to regulate the yarn tension. The above-mentioned intermediate member is provided with a capsule which creates a particular yarn passage to create yarn tension. Since the reserve disc is continuously rotated together with the spindle at a constant driving speed, when the yarn passes through a yarn passage between the above-mentioned intermediate member and the bottom aperture of the hollow spindle (hereinafter referred to as a first twisting passage), the yarn is twisted; while, when the yarn passes through a yarn passage between the outside aperture of the yarn guide passage of the reserve disc and the hollow yarn guide disposed above the entry tube (hereinafter referred to as a second twisting passage), the yarn is twisted. Consequently, the yarn is provided with two twisting times every revolution of the reserve disc, in other words, one turn of twist is imported to the yarn in the first twisting passage while another one turn of twist is imparted to the yarn in the second twisting passage. In the above-mentioned conventional double twister, a deflection plate is formed at a bottom portion of the hollow spindle in such a condition that the deflection plate extends radially from the central axis of the spindle and the outside edge thereof is extended outside from the deflection plate. Consequently, when the yarn passes through the second twisting passage, a ballooning of the yarn is formed between the outside edge of the deflection plate and the hollow yarn guide.

In the above-mentioned double twister, when a spun yarn is utilized as a material yarn, the material yarn is provided with a fuzzy appearance because of abrasion of the yarn during the previous yarn processing such as the winding operation for forming the yarn package. When the above-mentioned material undergoes the twisting operation by the double twister, the yarn is subjected to an abrasion action when the yarn is introduced into the entry tube via the yarn guide bush and, consequently, there is a possibility that the fuzzy appearance of the yarn will become more distinguished. Further, when the yarn passes through the yarn passage formed on the peripheral surface of the reserve disc, since the yarn slides on the peripheral surface of the reserve disc, a certain abrasion action is also imparted to the yarn and, therefore the processing yarn is additionally provided with fuzzy fibers projecting from the surface thereof. The above-mentioned phenomenon of creating fuzzy fibers is possibly enhanced by the influence of static electricity which is created by the sliding contact of the yarn with the above-mentioned yarn guide bush on the peripheral surface of the reserve disc. Consequently, the twisted yarn produced by the above-mentioned double twister becomes a distinguished fuzzy yarn and such fuzzy twisted yarn creates troubles such as frequent yarn breakages in the weaving or knitting process, disturbance to the smooth operation of the carriage during the knitting operation, and possible entanglement of adjacent yarns during the weaving operation by which the quality of the woven fabric is degraded.

To remove the above-mentioned fuzzy fibers from the twisted yarn, some finishing treatment such as a singeing operation is sometimes applied to the yarn. However, such after treatment of the twisted yarn increases the cost of the yarn and, as a result, the after treatment for removing the fuzzy fibers from the twisted yarn has not been applied except when the yarn is produced for particular purposes, for example for producing a sewing thread. With regard to the device for removing or eliminating the fuzzy fibers of the twisted yarn, there is at present no effective device which can be applied to the multiple twister such as the double twister. In view of the above, it is the principle object of the present invention to provide a method and device for preventing creation of fuzzy fibers on a yarn during the twisting operation of the multiple twister such as a double twister. To attain the purpose of the present invention, the fuzzy fibers projecting outside from the surface of yarn passes through either one of the above-mentioned twisting passges or both of these twisting passages. In the device according to the present invention, a particular member for twisting the fuzzy fibers into the main body of the yarn is disposed at a position along the yarn passage downstream from the yarn passage formed in the entry tube. One of the particular members is a contacting member which strokes the fuzzy fibers so as to attach the free portion of the fuzzy fibers to the main body of the yarn. In the present invention, an oiling member, which is disposed along the passage between the entry tube and the spindle, is used for eliminating the fuzzy fibers in the twisting operation.

DETAILED EXPLANATION OF THE INVENTION

The construction and function of the device applied to the double twister is hereinafter explained in detail. The general construction of the above-mentioned modified double twister is shown in FIG. 1, wherein an assembled portion, except the entry tube, spindle, reserve disc, deflection plate and the yarn guide disposed above the entry tube, may be understood as being composed of novel members introduced by the present invention.

Figure 1:
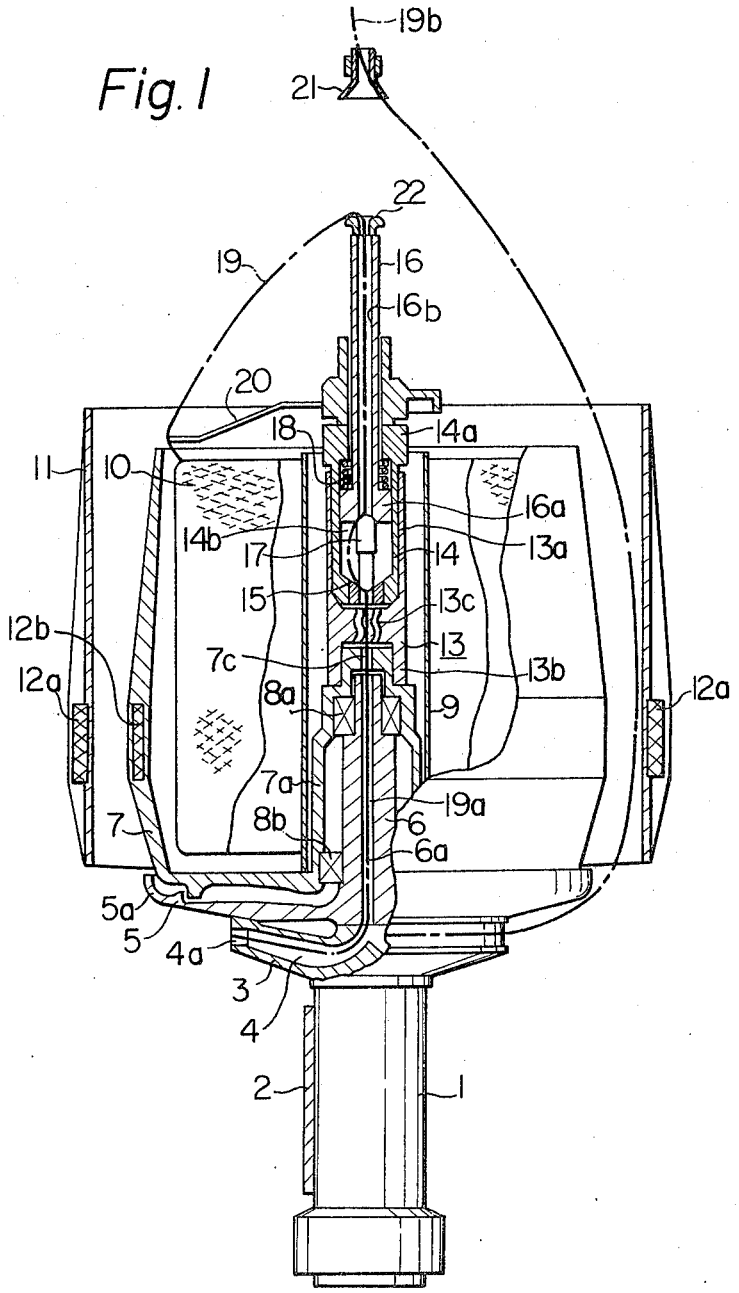
FIG. 1 is a view in axial section through a double twister embodying the device of the present invention.

In the modified double twister shown in FIG. 1, a spindle wharve 1 is driven by a driving belt 2, and a spindle 6 is mounted on the spindle wharve 1 in upright condition via a reserve disc 3 and a deflection plate 5. These members, that is, the spindle 6, the reserve disc 3 and the deflection plate 5 are provided with a common upright rotational axis which is also the rotational axis of the spindle wharve 1 and these members are assembled as one body. The spindle 6 is provided with an upright hollow yarn pasage 6*a* formed along the above rotational axis thereof and the reserve disc 3 is provided with a yarn guide passage 4 extending from the rotational axis thereof to an outside edge thereof. This yarn guide passage 4 is connected to the bottom aperture of the hollow yarn passage of the spindle and is provided with an outlet aperture 4*a*. The deflection plate 5 is coaxially and radially extended from the bottom portion of the spindle 6 and the edge 5*a* of the deflection plate 5 is located at a position outside the edge of the reserve disc 3. A protection pot 7, provided with a cylindrical tube portion 7*a*, is coaxially mounted on the spindle 6 in such a condition that the cylindrical tube portion 7*a* is supported by the spindle 6 via a pair of bearings 8*a* and 8*b*. A yarn package 10 is coaxially mounted on the cylindrical tube portion 7*a* of the protection pot 7 as shown in FIG. 1. A cylindrical balloon control member 11 is disposed by a supporting bracket (not shown) in such a condition that the cylindrical balloon control member 11 is coaxially positioned outside the protection pot 7 in stationary condition. A plurality of magnetic members 12*a* and 12*b* are rigidly mounted on the balloon control member 11 and the protection pot 7, respectively, in such a condition that one of the magnetic members 12*a* adjacently faces one of the magnetic members 12*b*. Consequently, the protection pot 7 can be held stationary during the driving of the spindle 6 by the magnetic action between these magnetic members 12*a* and 12*b*. A feed bushing 13 is provided with an upper and lower cylindrical portion 13*a* and 13*b* and the lower cylindrical portion 13*b* is rigidly mounted on the top end portion of the cylindrical tube portion 7*a*. A tenser container 14 is rigidly inserted into the upper cylindrical portion 13*a* and a small cylindrical member 15, made of a material having low frictional resistance, for example an alumina-ceramic, is rigidly inserted into the bottom portion of the tenser container 14. An entry tube 16 is movably supported by the tenser container 14 in such a way that the entry tube 16 is capable of displacing upward or downward in the tenser container 14. The top end portion of the entry tube 16 is projected upward from the upper horizontal edge of the protection pot 7. A capsule 17 is disposed in a space 14*b* formed in the tenser container 14 in such a condition that the capsule 17 contacts the bottom end of the entry tube 16 and the small cylindrical member 15. The entry tube 16 is provided with a laterally expanded portion 16*a* formed at a bottom end thereof and the tenser container 14 is provided with a laterally expanded portion 14*a* formed at a top head portion thereof so that a cylindrical space is formed between the tenser container 14 and the entry tube 16. A compressed helical spring 18 is coaxially mounted on the entry tube 16 at the above-mentioned cylindrical space so that the entry tube 16 always urges the capsule 17 downward. As shown in FIG. 1, the entry tube 16 is provided with a yarn passage 16*b* coaxially formed along a longitudinal axis thereof, while the feed bushing 13 is provided with a central yarn passage 13*c* formed at an intermediate portion between the upper and lower cylindrical portions 13*a* and 13*b*. The top portion of the cylindrical tube portion 7 *a* is provided with a central aperture 7*c*. The yarn passage 16*a* and the small cylindrical member 15, and the central yarn passage 13*c* and the central aperture 7*c* are aligned along a common central axis of the assembly thereof. A yarn 19 fed into the entry tube 16 passes through the yarn passage 16*a* and is introduced into the hollow yarn passage 6*a* of the spindle 6 via the space 14*b*, the small cylindrical member 15, the central yarn passage 13*c* and the central aperture 7*c*. Since the capsule 17 is sandwiched by the bottom end of the entry tube 16 and the small cylindrical member 15, the yarn 19 passes through the contactng portions between the entry tube 16 and the capsule 17, and between the small cylindrical member 15 and the capsule 17, and the yarn 19 is stretched when the yarn 19 passes through the above-mentioned contacting portions.

A flyer 20 is turnably mounted on the entry tube 16 at a position right above the tenser container 14 and the yarn 19 taken from the yarn package 10 is led to a yarn guide bushing 22 via a small yarn guide (not shown) formed at a free end of the flyer 20. A yarn guide 21 is disposed at a position coaxially above the yarn guide bushing 22. The yarn 19 is delivered from the outlet aperture 4*a* of the yarn guide passage 4 of the reserve disc 3 passes along a yarn passage formed on the entire peripheral surface of the reserve disc 3 at least one time and, then, is led to the yarn guide 21 while passing through a cylindrical space formed between the protection pot 7 and the balloon control member 11. Thereafter the twisted yarn is wound on a bobbin (not shown) by means of a winding device (not shown).

When the spindle wharve 1 is turned one revolution by the driving belt 2, the reserve disc 3, deflection plate 5 and the spindle 6 are turned one revolution toward the same turning direction as the spindle wharve 1. When the yarn 19 passes through the space 14*b* of the tenser container 14, the yarn 19 is gripped in sliding condition at the contacting point between the upper portion of the capsule 17 and the bottom portion of the entry tube 16, while also being gripped in sliding condition at the contacting point between the lower portion of the capsule 17 and the small cylindrical member 15, consequently, a ballooning of the yarn 19 is formed around the capsule 17 in the space 14*b*. Since the reserve disc 3 rotates the yarn 19 is twisted at the yarn passage between the contacting point of the lower portion of the capsule 17 with the small cylindrical member 15 and the bottom end portion of the upright yarn passage 6*a* of the spindle 6 in such a condition that the twisting of the yarn 19 is concentrated at the above-mentioned contact point in the yarn passage. When the above-mentioned firstly twisted yarn (designated 19*a* in the drawings) is led to the yarn guide 21 via the yarn passage formed on the peripheral surface of the reserve disc 3, the first twisted, yarn 19*a* forms a large ballooning in the cylindrical space between the protection pot 7 and the balloon control member 11. Consequently, the first twisted yarn 19*a* is secondly twisted by the above-mentioned ballooning and this second twisting of the yarn is concentrated at the contacting point of the yarn 19*a* with the yarn guide 21. THe secondly twisted yarn (designated 19*b* in the drawings) passes through the yarn guide 21 and is taken-up by a winding mechanism (not shown), and a yarn package (not shown) is formed from the secondly twisted yarn 19*b*. In the above-mentioned second twisting, turning of the yarn 19*a* about the longitudinal axis thereof is transmitted from the yarn guide 21 to the deflection plate 5. As mentioned above, in the modified double twister, the first twisting is applied to the yarn 19 in the yarn passage between the capusle 17 and the bottom end portion of the upright yarn passage 6*a* of the spindle, and the second twisting is applied to the firstly twisted yarn 19*a* in the yarn passage between the outlet aperture 4*a* of the yarn passage 4, formed in the reserve disc 3, and the yarn guide 21.

Figure 2:
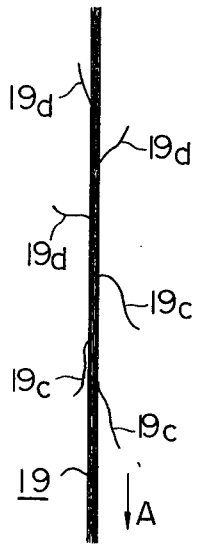
FIG. 2 is a perspective view of a yarn fed into the double twister from a yarn package mounted on the double twister.
Figure 3:
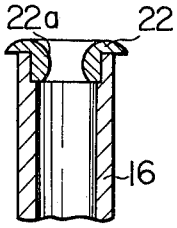
FIG. 3 is an axial cross-sectional view of an entry tube of the double twister shown in FIG. 1.

In the above-mentioned modified double twister, the yarn guide bushing 22 is useful to prevent the creation of fuzzy fibers on the surface of the yarn 19. When the yarn 19 taken from the yarn package 10 is introduced into the entry tube 16, the yarn 19 strongly rubs against the top edge of the entry tube 16 if such yarn guide bush 22 is omitted. In such condition, fuzzy fibers 19*c* are projected from the main body of the yarn 19 toward the running direction A of the yarn 19, and fuzzy fibers 19*d* are projected from the main body toward the direction opposite to the running direction A, as shown in FIG. 2. That is, the fuzzy fibers 19*c* having a leading hook and the fuzzy fibers 19*d* having a tail hook are projected from the main body of the yarn 19. The yarn guide bushing 22 is made of a material such as an alumina-ceramic material or electro-conductive titanium ceramic material, which is provided with very weak frictional resistance to the yarn 19. The yarn guide bushing 22 is provided with a particular shape to weaken the frictional resistance of the yarn guide bushing 22 to the yarn 19, that is, the edge of the top aperture thereof is provided with a smooth trumpet-like surface 22*a* as shown in FIG. 3. Therefore, when the yarn 19, taken from the yarn package 10, is introduced into the entry tube 16 via the yarn guide bush 22, the yarn 19 passes along the above-mentioned smooth trumpet-like surface 22*a* so that the rubbing action of the yarn guide bushing 22 is weakened very much. Consequently, the creation of fuzzy fibers 19*c*, 19*d* on the yarn surface can be restricted remarkably. Therefore, the above-mentioned yarn guide bushing 22 may be understood as an additional element of the device according to the present invention.

Figure 4:
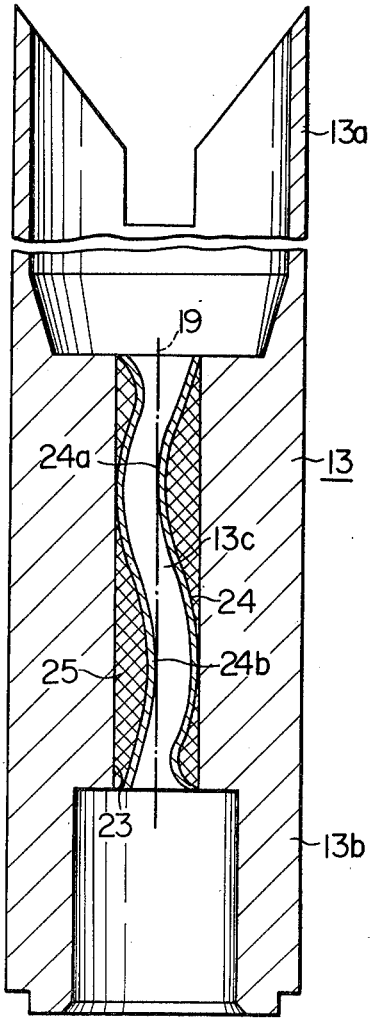
FIG. 4 is an axial cross-sectional view of a part of a feed bushing provided with a contacting member, applied to the double twister shown in FIG. 1.

In the present invention, the basic element to attain the purpose of the present invention is applied in the feed bushing 13 as shown in FIGS. 1 and 4. A central aperture 23 is formed in the intermediate portion between the upper and lower cylindrical portions 13*a* and 13*b* of the feed bushing 13 along the longitudinal axis of the feed bushing 13. A contacting element 24, which is made of a material such as an aluminum ceramic material or an electro-conductive titanium ceramic material having weak frictional resistance, is rigidly inserted into the central aperture 23. The contacting element 24 comprises a pair of componenet elements 24*a* and 24*b* facing each other in such a condition that the central yarn passage 13*c* is formed. The central yarn passage 13*c* forms a meandering yarn passage and the lateral cross section of the yarn passage 13*c* is round in shape. It is important to provide a contacting surface, which contacts the yarn 19, on each component element 24*a*, 24*b*, at different relative positions as shown in FIG. 4. The above-mentioned component elements 24*a* and 24*b* are assembled so as to form the above-mentioned meandering yarn passage by means of binding material 25 such as a bonding agent or a plastic material. In the case where the contacting element 24 is made of material having a property capable of absorbing static electricity, such as the electro-conductive titanium ceramic material, since the above-mentioned binding material 25, such as the bonding agent or the plastic material, does not have an electro-conductive property, it is necessary to put an electro-conductive member such as a metallic wire having electro-conductive property into the binding material 25. If this is not done, it is necessary to use a binding material 25 having an electro-conductive property.

When the above-mentioned contactng element 24 is utilized, the yarn 19 having fuzzy fibers 19*a*, 19*b* is forced to contact the contacting surfaces of the component elements 24*a*, 24*b* while the yarn 19 is turning about its longitudinal axis. Therefore, these fuzzy fibers 19*a*, 19*b* are folded toward the yarn surface of the main body of the yarn 19 and twisted into the main body according to the above-mentioned turning motion of the yarn 19. The other embodiments of the contacting element disposed in the feed bushing 13 are shown in FIG. 5 through FIG. 13.

Figure 5:
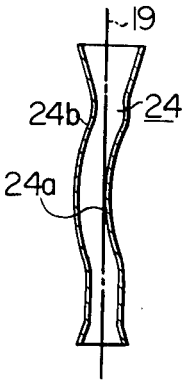
FIGS. 5, 6, 12 and 13 are axial cross-sectional views of the other embodiments of the contacting member according to the present invention.

The contacting element 24 shown in FIG. 5 is provided with a construction similar to the embodiment shown in FIG. 4. Consequently, the reference numerals 24*a*, 24*b* are used for indicating the component elements identical to the respective elements shown in FIG. 4. In this element, a single contacting surface is formed on the component element 24*a*. Therefore, it is easier to assemble the component elements 24*a* and 24*b* of this element as compared to the embodiment shown in FIG. 4, and the area of the above-mentioned contacting surface is larger than that of the embodiment shown in FIG. 4. Accordingly, even though the yarn 19 contacts only the above-mentioned single contacting surface, the same twisting-in effect of the fuzzy fibers into the main body of the yarn 19 as with the above-mentioned embodiment shown in FIG. 4 can be effected in the utilization of the contacting element shown in FIG. 5.

Figure 6:
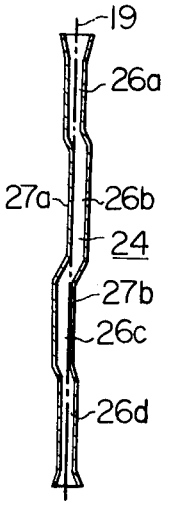

The contacting element 24 shown in FIG. 6 is made of a material having low frictional resistance such as an aluminum ceramic material or an electro-conductive ceramic material. The contacting element 24 of this embodiment is composed of four cylindrical bodies 26*a*, 26*b*, 26*c* and 26*d* assembled in zig-zag fashion along the yarn passage formed therein and a pair of contacting planes 27*a* and 27*b* are formed in the cylindrical bodies 26*b* and 26*c* as shown in FIG. 6. The yarn 19 contacts the contacting planes 27*a* and 27*b* successively while passing through the yarn passage formed in the contacting element 24. Consequently, the fuzzy fibers projected from the yarn surface of the yarn 19 are turned toward the surface of the main body of the yarn 19 which is rotating about its longitudinal axis, so that these fuzzy fibers are twisted into the main body of the yarn 19. Since the yarn 19 contacts the contacting surfaces 27*a* and 27*b*, respectively, for a time which is comparatively longer than the contacting time in the previous embodiments, preferable twisting-in action of the fuzzy fibers in the main body of the yarn 19 can be attained.

Figure 7:
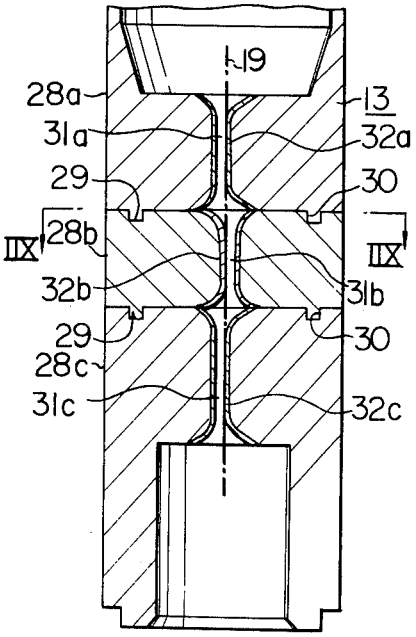
FIGS. 7, 9, 11, 14, 17, 21 and 22 are axial cross-sectional views of a part of the feed bushing provided with the respective modified contacting member, applied to the double twister shown in FIG. 1.
Figure 8:
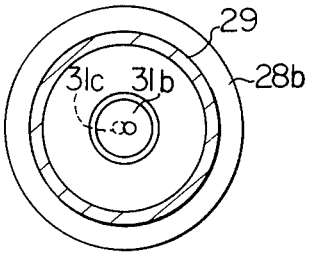
FIG. 8 is a cross-sectional view of the feed bushing, taken along the line IIX — IIX in FIG. 7.

The contacting element shown in FIGS. 7 and 8 are formed in the intermediate portion of the feed bushing 13 as explained hereinafter in detail. In this embodiment, the above-mentioned intermediate portion is divided into an upper portion 28*a* and a lower portion 28*c* and a central portion 28*b* assembled with the upper and lower portions 28*a*, 28*b* as shown in FIG. 7. An upper cylindrical yarn guide 31*a*, an intermediate cylindrical yarn guide 31*b* and a lower cylindrical yarn guide 31*c* are inserted into the above-mentioned portions 28*a*, 28*b* and 28*c*, respectively, so as to form a continuous yarn passage having a zig-zag passage. In this zig-zag yarn passage, the yarn 19 contacts firstly a contacting plane 32*a* formed in the upper yarn guide 31*a*, secondly contacts a contacting plane 32*b* formed in the intermediate yarn guide 31*b* and thirdly contacts a contacting plane 32*c* formed in the lower yarn guide 31*c*, successively. These cylindrical yarn guides 31*a*, 31*b* and 31*c* are made of a material having low frictional resistance titanium material. The working effect of the contacting element 24 is quite similar to the embodiment shown in FIG. 6. The relative axial positions of these cylindrical yarn guides 31*a*, 31*b* and 31*c* can be easily changed because of the construction of the portion 28*a*, 28*b* and 28*c*. That is, the upper portion 28*a* is provided with an annular ring 29 projected downward from the bottom surface thereof and the axial center of the yarn guide 31*a* is formed eccentrically from the axial center of the annular ring 29; while the center portion 28*b* is provided with an annular groove 30 formed in the top surface thereof in such a condition that the axial center of the yarn guide 31*b* is formed eccentrically from the axial center of the annular groove 30, and the annular ring 29 is slidably engaged in the annular groove 30; the intermediate portion 28*b* and the lower portion 28*c* are provided with the same type of annular ring 29 and annular groove 30, respectively, and are connected in the same manner as the portions 28*a* and 28*b*. Consequently, the zig-zag condition of the continuous yarn passage can be changed by relatively turning at least one of the above-mentioned three portions 28*a*, 28*b* and 28*c*. Therefore, the contacting condition of the yarn 19 with the contacting plane of the yarn guides 31*a*, 31*b* and 31*c* can be easily adjusted. It is one of the major advantage of the present invention that the working effect of contacting element 24 can be easily changed by relatively turning these three portions 28*a*, 28*b* and 28*c* so as to make a suitable contacting condition for the material of the yarn 19.

Figure 9:
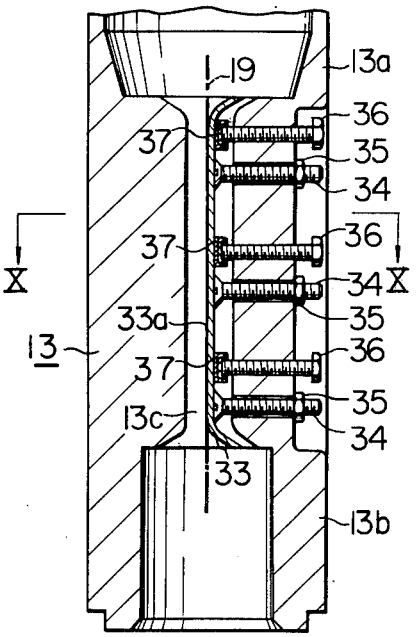
Figure 10:
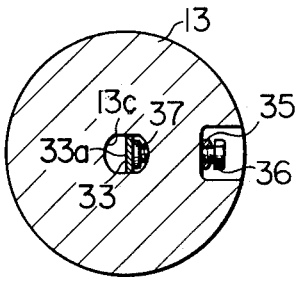
FIG. 10 is a cross-sectional view of the feed bushing, taken along the line X — X in FIG. 9.

In the embodiment of the feed bushing 13 shown in FIGS. 9 and 10, the central yarn passage 13*c* formed in the feed bush 13 is provided with an elliptical lateral cross-section and a plate contacting member 33 is movably inserted into the central yarn passage 13*c* as shown in FIGS. 9 and 10. An inside surface 33*a* of the plate contacting member 33 is plated with chrome or is provided with a satin finish and, consequently, the inside surface of the plate contacting member 33 has a property of low frictional resistance. Threaded rods 34 and 36 are mounted on the feed bushing 13 so as to adjust the lateral cross-sectional area of the central yarn passage 13*c*. Each threaded rod 36 is engaged into a shoe 37 secured to the plate contacting member 33 so that a portion of the member 33 can be displaced toward the right-hand direction in FIG. 9 by turning the rod 36 so as to displace the shoe 37 toward the right-hand direction. On the other hand, the position of each threaded rod 34 is fixed by a fastening nut 35 and a free end thereof is capable of pushing the contacting member 33 and, consequently, the contacting member 33 is capable of displacing toward the left-hand direction in FIG. 9 by turning the rod 34 so as to push the contacting member 33. Accordingly, the transversal position of the contacting member 33 can be partly changed by means of the threaded rods 34 and 36 so as to create the desired actual contacting surface of the member 33. When the yarn 19 passes through the yarn passage 13*c*, the yarn 19 contacts the above-mentioned contacting surface created by means of the threaded rods 34 and 36 and, therefore, a very effective twisting-in operation of the fuzzy fibers 19*a*, 19*b* (FIG. 2) into the main body of the yarn 19 can be carried out. In the above-mentioned embodiment, since the turning torque of the yarn 19 about the longitudinal axis thereof is gradually weakened from the upstream position to the downstream position of the yarn passage 13*c*, it is preferable to gradually weaken the frictional contact of the yarn 19 against the inside surface of the contacting member 33 from the upstream position to the downstream position of the yarn passage 13*c*. To create the above-mentioned condition, the threaded rods 34 and 36 are fixed in such a condition that the contacting areas of the inside surface of the contacting member 33, which area are controlled by the respective threaded rods 34, 36, are gradually reduced from the upstream position to the downstream position of the yarn passage 13*c*.

Figure 11:
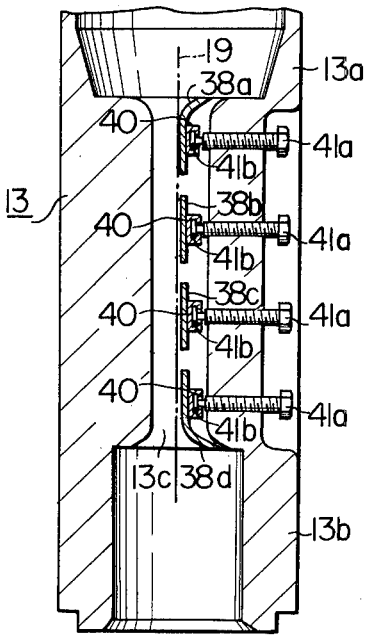

The embodiment of the feed bushing 13 shown in FIG. 11, is a modification of the embodiment shown in FIG. 9. In this embodiment, the contacting member inserted into the yarn passage 13*c* is divided into four pieces 38*a*, 38*b*, 38*c* and 38*d*. The surface condition of each piece 38*a*, 38*b*, 38*c* and 38*d* is similar to the contacting member 33 shown in FIG. 9. A shoe piece 40 is secured to each piece of the contacting member at the side opposite to the inside surface of each contacting piece 38*a*, 38*b*, 38*c* and 38*d*. A position fixing threaded rod 41*a* is engaged into each shoe piece 40 in such a way that the position of the contacting pieces 38*a*, 38*b*, 38*c* and 38*d* can be fixed by turning the respective threaded rod 41*a*. In this embodiment, to create a better twisting-in of the fuzzy fibers into the main body of the yarn 19, it is desirable that the transversal cross-sectional area of the yarn passage 13*c* be gradually increased from the upstream position to the downstream position thereof. Instead of applying the transversal cross-section of the yarn passage 13*c* having an elliptical shape in the embodiments shown in FIGS. 10 and 11, a round transversal cross-section can be applied for the yarn passage 13*c*.

Figure 12:
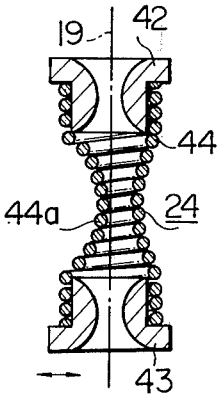
Figure 13:
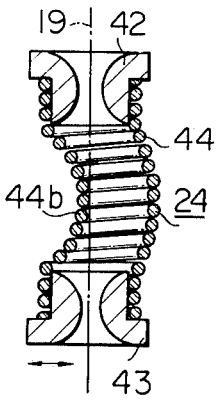

In the embodiment of the contacting member shown in FIGS. 12 and 13, the contacting member 24 comprises a pair of guide bushings 42, 43 made of a material having low frictional resistance such as an aluminum ceramic material and a coiled wire 44. In FIG. 12, the coil wire 44 of the contacting member 24 has a particular outer profile wherein the yarn passage formed in the coiled wire 44 is provided with a transversal cross-section which gradually expands from the middle portion thereof to the upstream and downstream end portion thereof, and the middle portion 44*a* of the yarn passage contacts the yarn 19. In the embodiment shown in FIG. 13, the yarn passage curves along the running direction of the yarn 19 and, consequently, a part 44*b* of the inside surface of the yarn passage works as a contacting surface for twisting-in the fuzzy fibers into the main body of the yarn 19. In the two embodiments shown in FIGS. 12 and 13, the area of the contacting surface created by the coiled wire 44 can be easily changed by laterally changing the relative position of either one of the guide bushings 42 or 43 to the other bushing 43 or 42.

Figure 14:
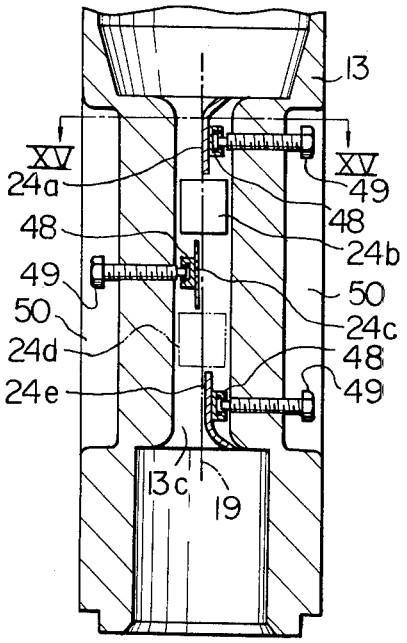
Figure 15:
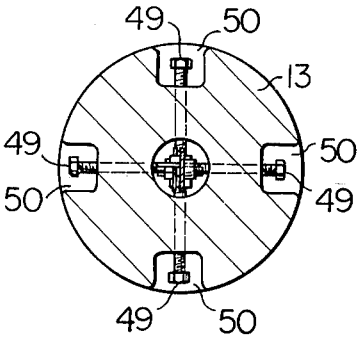
FIG. 15 is a cross-sectional view of the feed bushing, taken along the line XV — XV in FIG. 14.
Figure 16:
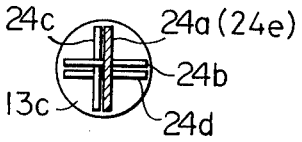
FIG. 16 is an enlarged view of the relative arrangement of the contacting member, taken from an axially upward position thereof, in FIG. 14.
Figure 17:
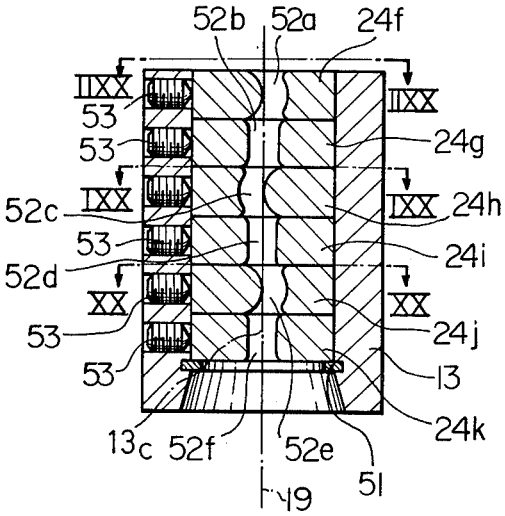

The embodiments of the contacting member shown in FIGS. 14, 15 and 16 are a modification of the contacting member shown in FIG. 11. In this embodiment, a plurality of contacting members 24*a*, 24*b*, 24*c*, 24*d* and 24*e* are disposed in the yarn passage 13*c* in such a way that they are disposed at respective positions which are radially symmetric with respect to the central axis of the yarn passage 13*c*. That is the relative angular disposition between these contacting members 24*a* and 24*b*, 24*b* and 24*c*, 24*c* and 24*d*, 24*d* and 24*e*, with respect to the central axis of the yarn passage 13*c* is represented by 90° as shown in FIG. 16. Each of these contacting members 24*a*, 24*b*, 24*c*, 24*d* and 24*e* is provided with a shoe piece 48 and an adjusting bolt 49 engages into the corresponding shoe piece 48. The adjusting bolt 49 is threaded into the feed bushing 13 so as to displace the shoe piece 48 along the transversal direction with respect to the central axis of the yarn passage 13*c*. Consequently, the transversal position of these contacting members 24*a*, 24*b*, 24*c*, 24*d* and 24*e* can be preferably adjusted by turning the corresponding adjusting bolt 49. In this embodiment of the contacting member according to the present invention, to assure free mounting of the yarn package 10 on the feed bushing 13, a plurality of longitudinal grooves 50 are formed on the peripheral surface of the feed bushing 13, in which grooves 50 the heads of the adjusting bolts 49 are positioned. According to our experimental tests, it is preferable that the action of the contacting member 24*a* disposed at the uppermost position be the strongest, and the actions of the contacting members 24*b*, 24*c*, 24*d* and 24*e* are gradually weakened from the member 24*b* to the member 24*e*. When the yarn 19 passes through the yarn passage 13*c*, there is a tendency to create small ballooning. Consequently, if the contacting member of the feed bushing 13 works against the yarn 19 from only one transversal direction with respect to the running direction of the yarn 19, there is a posibility of the yarn 19 contacting the contacting member in a jumping condition, i.e., intermittently. However, in this embodiment, since the contacting members 24*a*, 24*b*, 24*c*, 24*d* and 24*e* are capable of contacting the yarn 19 in a surrounding condition, a very stable twisting-in action of the contacting member can be created.

In the above-mentioned embodiment of the contacting member, the number of the component elements 24*a*, 24*b* .... can be changed. Further, component elements 24*a*, 24*b*... having a round recessed surface may be utilized instead of the component elements 24*a*, 24*b*... having flat contacting surface shown in FIGS. 14 and 16.

Figure 18:
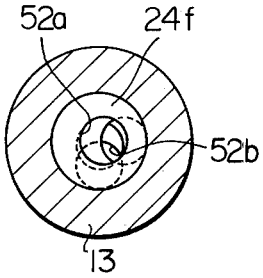
FIGS. 18, 19 and 20 are cross-sectional views of the feed bushing taken along the line IIXX — IIXX, the line IXX — IXX, the line XX, in FIG. 17.
Figure 19:
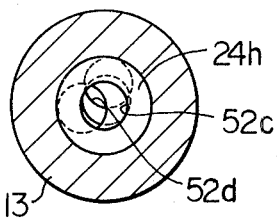
Figure 21:
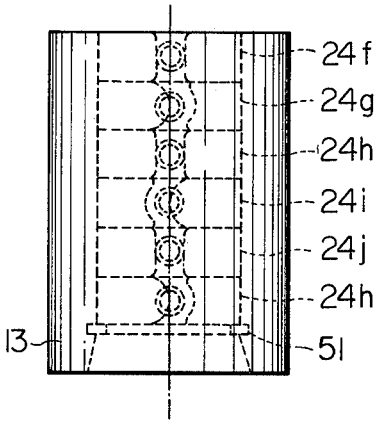
Figure 20:
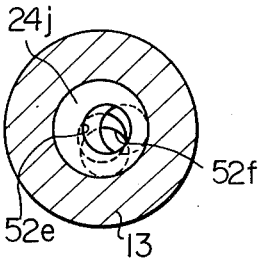

A further modified embodiment of the contacting member according to the present invention is shown in FIGS. 17, 18, 19, 20 and 21. The contacting member is a modification of the contacting member shown in FIGS. 7 and 8. In this embodiment, a supporting ring 51 is rigidly mounted on a bottom inside portion of the feed bushing 13, and a plurality of contacting members 24*f*, 24*g*, 24*h*, 24*i*, 24*j* and 24*k* are superimposed on the supporting ring 51. Apertures 52*a*, 52*b*, 52*c*, 52*d*, 52*e* and 52*f* are respectively formed in the contacting members 24*f*, 24*g*, 24*h*, 24*i*, 24*j* and 24*k*, so as to form the continuous zig-zag yarn passage 13*c*. The yarn 19 contacts the inwardly projected surfaces of some of the above-mentioned contacting members. In this embodiment the apertures 52*a*, 52*c* and 52*e* are formed eccentrically in the contacting members 24*f*, 24*h* and 24*j*, respectively, and consequently, the zig-zag condition of the yarn passage 13*c* can be changed by relative angular disposition of these members 24*f*, 24*h* and 24*j* when they are assembled. After assembling these contacting members 24*f*, 24*g*, 24*h*, 24*i*, 24*j* and 24*k*, the relative angular positions thereof are fixed by fastening respective fastening bolts 53. As shown in FIGS. 18, 19 and 20, the contacting surfaces of these contacting members are arranged in such a condition that the phase difference thereof along the transversal plane with respect to the running direction of the yarn 19 in the yarn passage 13*c*, between each two of the above-mentioned contacting surfaces, is 90°. Consequently, even though the yarn 19 contacts the above-mentioned contacting surfaces, very stable twisting-in action by the contacting members can be expected. In the above-mentioned embodiment, the number of the contacting members, the eccentricity of the apertures and the curvature of the contacting surfaces of these contacting members may be changed so as to attain the purpose of the present invention.

Figure 22:
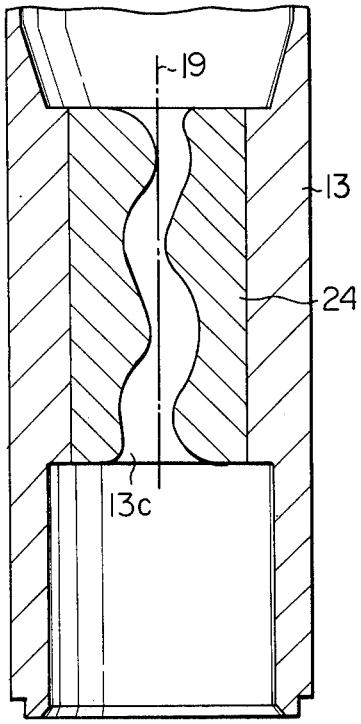
Figure 23:
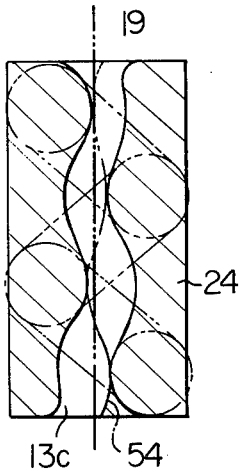
FIG. 23 is a cross-sectional view of the contacting member shown in FIG. 22, which indicates the shape of the yarn passage therein.

The feed bushing 13 shown in FIGS. 22 and 23 is provided with a contacting member 24 wherein a spiral yarn passage 13*c* is formed. The lateral cross-section of this spiral yarn passage 13*c* is gradually enlarged from the upstream position to the downstream position thereof and, consequently, the frictional action of the contacting surface is gradually weakened from upstream position to the downstream position of the yarn passage 13*c*. The contacting surface formed in the yarn passage 13*c* passes along a trace 54 which is represented by a dot-dash line shown in FIG. 23, and the yarn 19 receives the frictional action of the contacting surface from all radial directions with respect to the running direction thereof. Therefore, even if the yarn 19 jumps in the yarn passage 13*c*, very stable twisting-in action by the contacting member 24 is imparted to the yarn 19.

In the above-mentioned explanation concerning the contacting members 24, these contacting members 24 are disposed in the feed bushing 13 at a position just below the capsule 17. However, such contacting member 24 can be satisfactorily disposed at any position along the yarn passage between the capsule 17 and reserve disc 3.

Beside the above-mentioned contacting member 24, an additional means for eliminating the fuzzy fibers can be effectively utilized in the yarn passage between the deflection plate 5 and the yarn guide 21.

Figure 24:
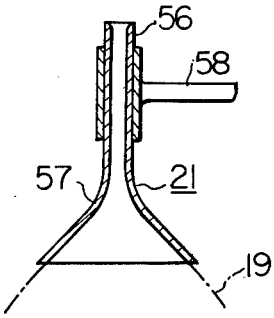
FIGS. 24, 25, 26, 28 and 29 are sectional views of the yarn guide disposed at a position above the entry tube of the double twister, according to the present invention.

Referring to FIGS. 1 and 24, a yarn guide 21 composed of an upper cylindrical portion 56 and a lower conical portion 57 can be utilized as an additional means for eliminating the fuzzy fibers. This yarn guide 21 is held by a supporting bracket 58 which holds the cylindrical portion 56. When the first twisted yarn 19*a* is carried to the yarn guide 21, the yarn 19*a* forms a ballooning and, consequently, the yarn 19*a* contacts the inside contacting surface of the conical portion 57 and, thereafter, passes through the cylindrical portion 56. According to the above-mentioned contact of the yarn 19*a* with the inside contacting surface of the conical portion 57, the yarn 19*a* turns about the longitudinal axis thereof while turning through the cylindrical space between the protection pot 7 and the balloon control member 11. Therefore, the fuzzy fibers projected from the main body of the first twisted yarn 19*a*, which are created by the rubbing contact of the yarn 19*a* with the reserve disc 3 and the edge 5*a* of the deflection plate 5, are turned toward the main body of the yarn 19*a* by the above-mentioned contact of the yarn 19*a* with the inside contacting surface of the conical portion 57 and, consequently, these fuzzy fibers are twisted-in the main body of the yarn 19*a*.

Figure 25:
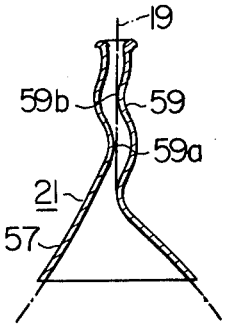

Another embodiment of the yarn guide 21 according to the present invention is shown in FIG. 25. In this embodiment, a meandering hollow portion 59 is formed instead of the cylindrical portion 56. This meandering hollow portion 59 provides a pair of contacting surfaces 59*a* and 59*b*. Consequently, the yarn 19*a* is frictionally contacted to these contacting surfaces 59*a* and 59*b*, after passing through the conical portion 57, so that a very effective action for eliminating the fuzzy fibers can be created.

Figure 26:
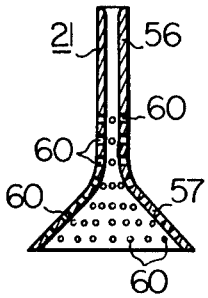
Figure 27:
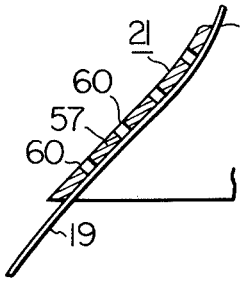
FIG. 27 is an enlarged cross-sectional view of a part of the yarn guide shown in FIG. 26.

In the embodiment of the yarn guide 21 shown in FIGS. 26 and 27, which is a modification of the yarn guide 21 shown in FIG. 24, a plurality of small apertures 60 are formed in the conical portion 57 and the cylindrical portion 56. Each of these small apertures 60 is provided with a space which permits the free escape of some of the fuzzy fibers therethrough. When the yarn 19*a*, having the fuzzy fibers, passes through the yarn guide 21, as the yarn 19*a* contacts the inside surface of the conical portion 57, the fuzzy fibers of the yarn 19*a* enter the small apertures 60. Consequently, since the yarn 19*a* rotates on its own axis, turns along the circumference of the inside surface of the conical portion 57 and runs upwards, the shorter of the fuzzy fibers are laid down on the main body of the yarn 19*a* to be twisted into the main body of the yarn 19*a*. However, the longer of the fuzzy fibers are severed from the main body of the yarn 19*a*, because of the strong frictional action created by the edge of each of the small apertures 60. Even if the longer of the fuzzy fibers are not severed from the main body of the yarn 19*a*, they are forced to lay down on the main body of the yarn 19*a* so that they are twisted into the main body of the yarn 19*a*.

Figure 28:
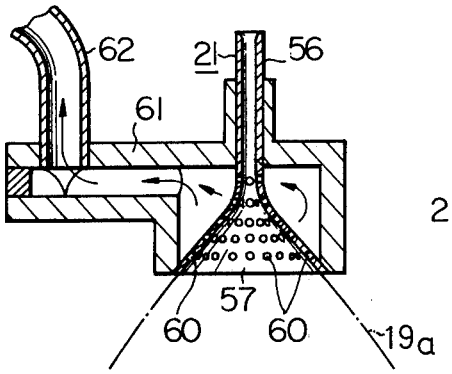

In the embodiment shown in FIG. 28, which is a modification of the yarn guide 21 shown in FIG. 26, the yarn guide 21 is disposed in a suction box 61 and the suction box 61 is connected to a suction source (not shown) via a suction duct 62. Consequently, even if the condition of the ballooning of the yarn 19*a* is changed, because of variety of the yarn, twisting condition, etc., the yarn 19*a* is forced to contact the inside contacting surface of the conical portion 57 of the yarn guide 21 by the suction air via the small apertures 60 and the fuzzy fibers of the yarn 19*a* are also positively introduced into these apertures 60. Consequently, a more effective twisting-in action of the fuzzy fibers into the main body of the yarn 19*a*, in comparison with the embodiment shown in FIG. 26, can be created. If long fuzzy fibers are separated from the yarn 19a by the above-mentioned contact of the yarn 19a to the conical portion 57 of the yarn guide 21, these separated fuzzy fibers are carried into the suction box 61 via the apertures 60.

Figure 29:
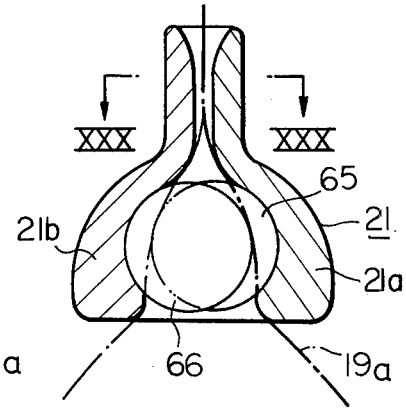
Figure 30:
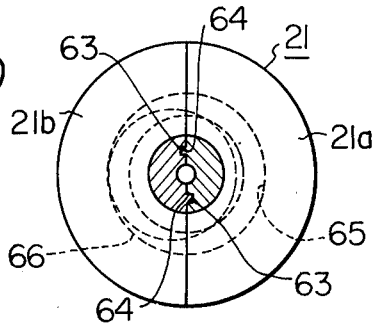
FIG. 30 is a plan view of the yarn guide shown in FIG. 29.

Another embodiment of the yarn guide 21 according to the present invention is shown in FIGS. 29 and 30. In this embodiment, the yarn guide 21 is an assembled body composed of a pair of elements 21a and 21b, each having a spherical recess, and a ball 66 freely disposed in a room 65 formed by the above-mentioned two spherical recesses. The elements 21a and 21b are provided with projections 63 and recesses 64 which receive the projections 63 so as to form the yarn guide 21. The inside spherical surface of the room 65 is finished so as to form a smooth, hard spherical surface. The ball 66 is a hollow body so as to be able to rotate freely in the above-mentioned room 65. When the yarn 19a passes through the yarn guide 21, the yarn 19a firstly contacts the bottom edge of the yarn guide 21 and then is carried upward while contacting the surface of the ball 66. Consequently, the fuzzy fibers of the yarn 19a are twisted-in the main body of the yarn 19a while passing through the yarn guide 21. At the time of starting the twisting operation, the ballooning of the yarn 19a is small, however, the yarn 19a is forced to contact the bottom edge of the yarn guide 21 and the surface of the ball 66 and, consequently, effective twisting-in operation of the fuzzy fibers into the main body of the yarn 19a can be created by the above-mentioned yarn guide 21.

The effect of the twisting-in operation of the fuzzy fibers into the main body of the yarn according to the present invention, wherein the first twisting-in operation is carried out in the yarn passage at the capsule 17 and the second twisting-in operation is carried out when the first twisted yarn 19a passes through the yarn guide disposed above the entry tube of the double twister, is hereinafter explained.

Figure 31:
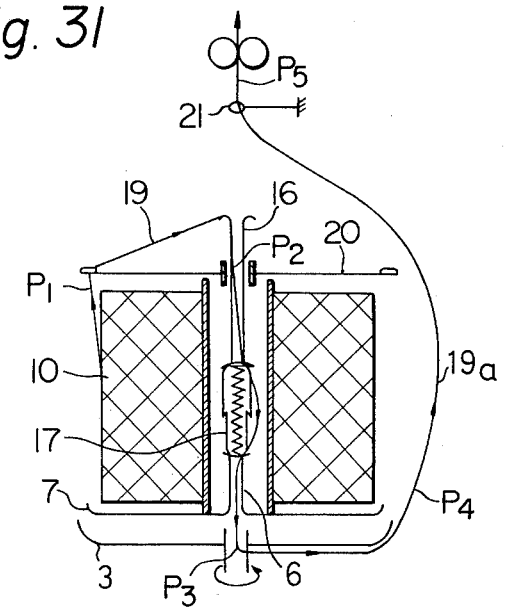
FIG. 31 is a schematic cross-sectional view of the double twister embodying the device of the present invention.
Figure 32:
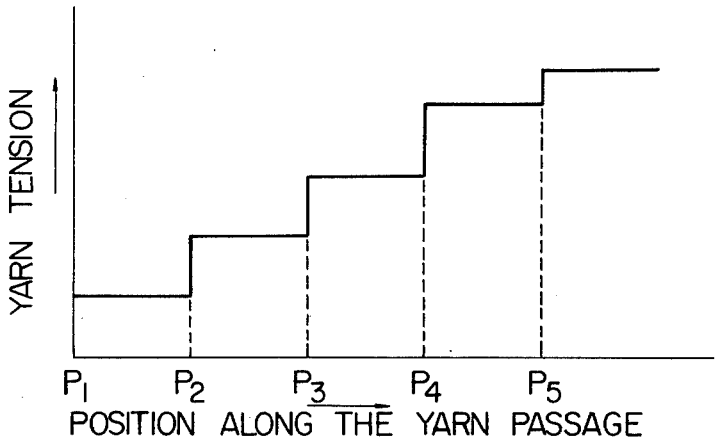
FIG. 32 is an explanatory diagram indicating the relation between the yarn tension and the positions along the yarn passage in the double twister shown in FIG. 31.

Referring to FIGS. 31 and 32, the yarn tension imparted to the yarn 19 at the position $P_1$ just upstream from the flyer 20 corresponds to the unwinding yarn tension which is a tension for unwinding the yarn from the yarn package 10. The yarn tension imparted to the yarn 19 at the position $P_2$ in the entry tube 16 corresponds to the above-mentioned unwinding tension plus a tension created by the turning motion of the flyer 20. The yarn tension imparted to the yarn 19a at the position $P_3$ which is at the bottom of the spindle 6 corresponds to the above-mentioned yarn tension at the position $P_2$ plus the tension created by the capsule 17. The yarn tension imparted to the yarn 19a in the yarn passage right after the reserve disc 3 (position $P_4$) is the tension at the position $P_3$ plus the tension created by sliding the yarn 19a around the peripheral surface of the reserve disc 3. Finally, the yarn tension imparted to the yarn 19a right after passing the yarn guide 21 (position $P_5$) corresponds to the yarn tension at the position $P_4$ plus the tension created by the ballooning between the deflection plate (not shown) and the yarn guide 21. Consequently, the yarn tension which is imparted to the yarn in the passage for imparting the first twist between the capsule 17 and the bottom of the spindle 6, is weaker than the yarn tension, which is imparted to the yarn in the passage for imparting the second twist between the reserve disc 3 and the yarn guide 21. Accordingly, in the passage for imparting the first twist, it is essential not to disturb the effective turning motion of the yarn itself about the longitudinal axis thereof so as to impart the first twists to the yarn 19, if the device of the present invention, that is the contacting member hereinbefore explained is disposed in the above-mentioned yarn passage. In the above-mentioned yarn passage for imparting the first twist, since the yarn is not as compact as the second twisted yarn, the fuzzy fibers can be easily turned to the main body of the yarn and twisted into the main body. However, in tests it has been observed that some of the longer fuzzy fibers still remain in a projected condition from the main body of the first twisted yarn 19a. As hereinbefore explained, because a stronger yarn tension is imparted to the first twisted yarn 19a in the yarn passage for imparting the second twists, a stronger frictional action for eliminating the fuzzy fibers can be applied to the first twisted yarn 19a without disturbing effective turning of the yarn 19a about the longitudinal axis thereof and the effective ballooning of the first twisted yarn 19a. Consequently, a very effective action for eliminating the projection of fuzzy fibers from the main body of the yarn 19a can be created by applying the particular construction to the yarn guide 21 as hereinbefore explained. Based on tests it has been confirmed that the fuzzy fibers twisted into the main body of the second twisted yarn are stably held in. Therefore, it may be understood that the device according to the present invention embodied in the double twister has a function such that the fuzzy fibers projected from the main body of the supplied yarn are forced to be twisted into the main body of the supplied yarn without disturbing the effective turning of the supplied yarn about the longitudinal axis thereof in the yarn passage for imparting the first twist or the second twist, in the double twister.

According to the explanation illustrated hereinbefore, it may be understood that the device of the present invention can be disposed in the yarn passage for imparting the first twist to the yarn 19 or in the yarn passage for imparting the second twist to the first twisted yarn 19a. However, it is preferable that a pair of the devices of the present invention be utilized for the double twister in such a way that a first device, that is a contacting member, is disposed in the yarn passage for imparting the first twist to the yarn 19 while a second device, that is a yarn guide having the particular construction hereinbefore explained, is utilized as a terminal of the yarn passage for imparting the second twist to the first twisted yarn 19a.

Figure 33:
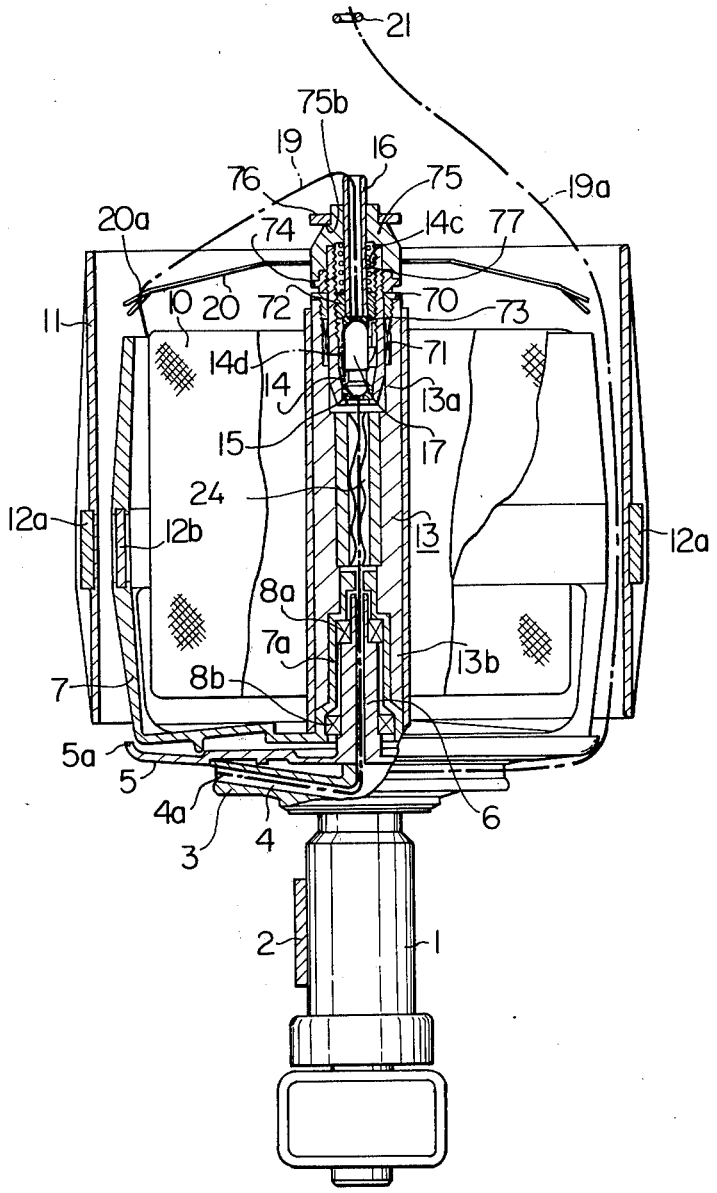
FIG. 33 is a view in axial section through another type of double twister embodying the device of the present invention.

In our experimental tests, it was confirmed that, in the double twister shown in FIG. 1, if the so-called unwinding twist is imparted to the yarn 19 in the yarn passage between the flyer 20 and the guide bush 22 rigidly mounted on the entry tube 16, the effective twisting — inn operation of fuzzy fibers into the main body of the yarn 19 in the yarn passage downstream of the contacting point of the lower portion of the capsule 17 with the small cylindrical member 15 is disturbed. However, since the tension means comprising the tensor container 14, small cylinder 15, capsule 17 and the small entry tube 16 is turned together with the flyer 20, the above-mentioned unwinding twist is imparted to the yarn right after the yarn passes through the contacting point of the lower portion of the capsule 17 with the small cylinder 15. Consequently, the above-mentioned possible disturbance due to the unwinding twist can be effectively eliminated when the supplied yarn 19 contacts the entrance edge of the guide bush 22. Consequently, even though the contacting member 24 works to twist in the above-mentioned fuzzy fibers into the main body of the yarn 19, it is preferable to prevent such easy creation of the fuzzy fibers. The embodiment shown in FIG. 33, is provided with a particular construction for preventing the above-mentioned easy creation of the fuzzy fibers. That is, in the double twister shown in FIG. 33, the entry tube 16 and a tension mechanism provided with the tenser container 14 and the capsule 17 are capable to turning with the flyer 20. In the following explanation of the double twister wherein the device of the present invention is applied, the component elements having a similar function to the component elements of the double twister shown in FIG. 1 are represented by the identical reference numerals, respectively, and the explanation thereof is omitted.

Figure 34:
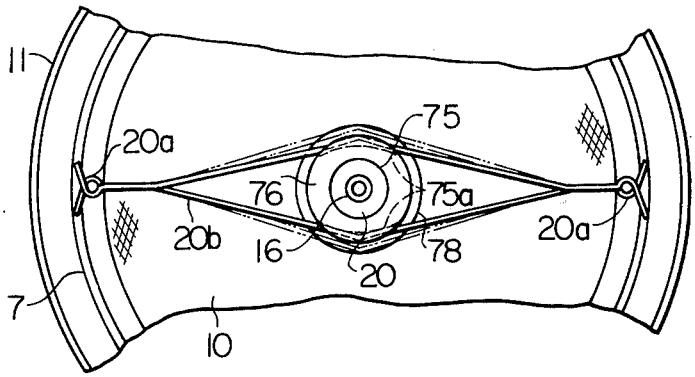
FIG. 34 is a plan view of a part of the double twister shown in FIG. 33.
Figure 35:
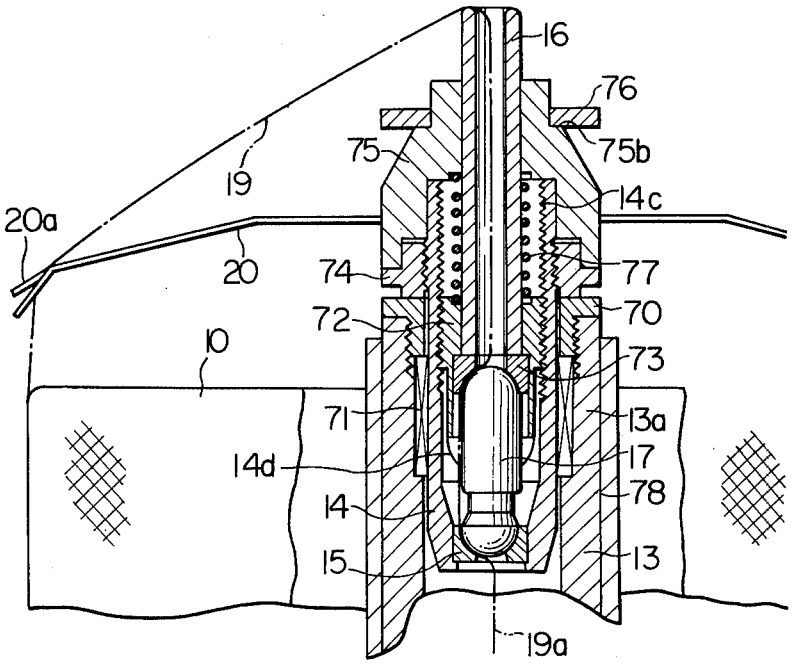
FIG. 35 is an axial cross-sectional view of a part of the double twister shown in FIG. 33.

Referring to FIGS. 33, 34 and 35, a sliding disc 70 is coaxially mounted on the upper portion 13*a* of the feed bushing 13 by means of thread engagement. The tenser container 14 is rotatably mounted in the upper portion 13*a* of the feed bushing 13 by way of a needle bearing 71, the upper cylindrical inside wall 14*c* is provided with a screw thread and an aperture 14*d* is formed in the outer wall thereof. As in the embodiment shown in FIG. 1, the small cylindrical member 15, made of a material having low frictional resistance such as an aluminum ceramic material, is disposed at the bottom portion of the tenser container 14. A cylindrical body 72 is secured to a middle portion of the tenser container 14 by thread engagement and an upper cylindrical body 73 is disposed in the tenser container 14 at a position just below the level of the body 72. The capsule 17 is sandwiched by the upper cylindrical body 72 and the small cylindrical member 15. The capsule 17 is provided with an expansion spring (not shown) disposed therein and the capsule 17 has a construction such that it is capable of longitudinaly expanding. Consequently, the upper and lower ends of the capsule 17 are urged to the upper cylindrical body 73 and the small cylindrical member 15, respectively. As a result, the yarn 19 is stretched when it is pulled from the contacting points between the lower end of the capsule 17 and the small cylindrical member 15. The tension of the yarn 19 can be changed easily by changing the capsule 17 so as to change the expansion force thereof due to the expansion spring disposed therein. If it is required to adjust the above-mentioned yarn tension a little, it is sufficient to turn the entry tube 16 so that the cylindrical body 72 is displaced upward or downward along the longitudinal axis of the tenser container 14 so that the upper cylindrical body 73 is displaced upward or downward. A flyer ring 74 is rigidly mounted on the tenser container 14 at an upper portion thereof by thread engagement as shown in FIG. 35. A base portion 75 of the flyer 20 is rigidly mounted on the entry tube 16 in such a condition that the base portion 75 contacts the flyer ring 74. Fixing grooves 75*a* are formed on the outer surface of the base portion 75 and a step portion 75*b* is formed at the upper end portion of the base portion 75 of the flyer 20.

A flyer guide 20*b* of a resilient metallic material is detachably inserted into the grooves 75a as shown in FIG. 34, and a pair of yarn guides 20*a* is formed at the free ends of flyer guide 20*b*. Accordingly, the entry tube 16 and the tension mechanism, comprising the tenser container 14 and the capsule 17, etc., are capable of turning together with the flyer 20 and the unwinding twist is imparted to the yarn 19 at a position below the capsule 17. In the above-mentioned embodiment, a weight 76 is detachably mounted on the step portion 75*b* of the base portion 75 of the flyer 20. Therefore, the bottom surface of the flyer ring 74 is frictionally contacted to the upper surface of the sliding disc 70 so that free turning of the assembled body, composed of the flyer 20 and the entry tube 16, and the tension mechanism, comprising the tenser container 14 and the capsule 17, can be prevented. If it is required to increase the driving speed of the spindle 6, it is preferable to use aweight 76 having increased weight. An expansion spring 77 is mounted on the entry tube 16 at a position between the base portion 75 of the flyer 20 and the cylindrical body 72 and, consequently, the disposition of the cylindrical body 72 relative to the entry tube 16 can be stably maintained. The contacting member 24 inserted into the feed bushing 13 works to twist-in the fuzzy fibers into the main body of the yarn 19 in a manner similar to the embodiment shown in FIG. 1.

Figure 36:
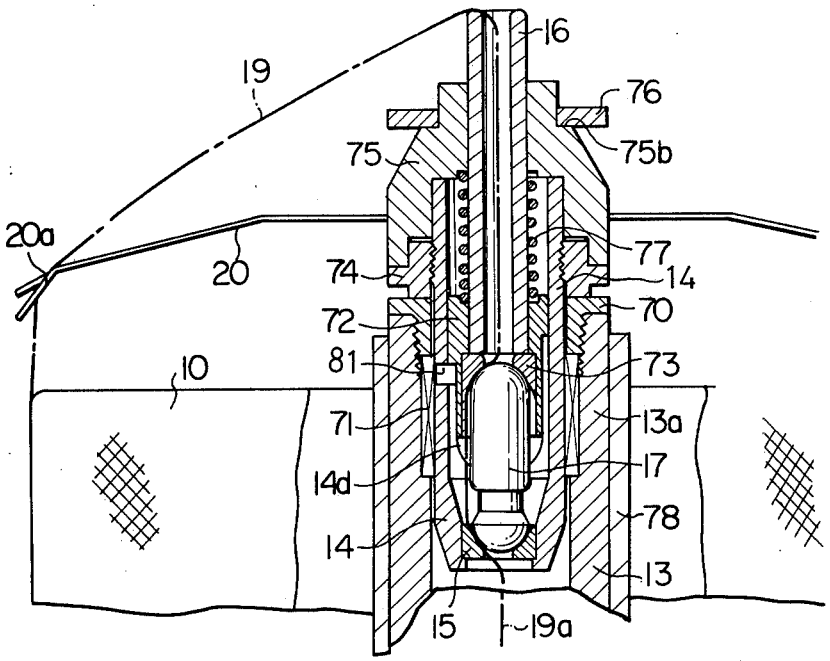
FIG. 36 is an axial cross-sectional view of a part of a double twister, which is a modification of the double twister shown in FIG. 33.
Figure 37:
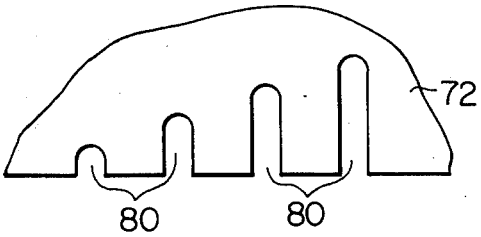
FIG. 37 is an exploded view of a part of a tenser container shown in FIG. 36.

The mechanism shown in FIGS. 36 and 37 is a modified device for adjusting the yarn tension in the tension mechanism which is applicable to the double twister shown in FIG. 33. In this tension mechanism, the cylindrical body 72 is provided with a plurality of engaging grooves 80 formed with an identical interval therebetween at the bottom portion of the cylindrical body 72, and the tenser container 14 is provided with a pin 81 projected inward from the inside wall at a position where the pin 81 is capable of being inserted into any one of the above-mentioned grooves 80. The engaging grooves 80 are provided with lengths which are different from each other. Therefore, the pushing force created by the spring 77 can be easily changed by changing the groove 80 which receives the pin 81.

Figure 38:
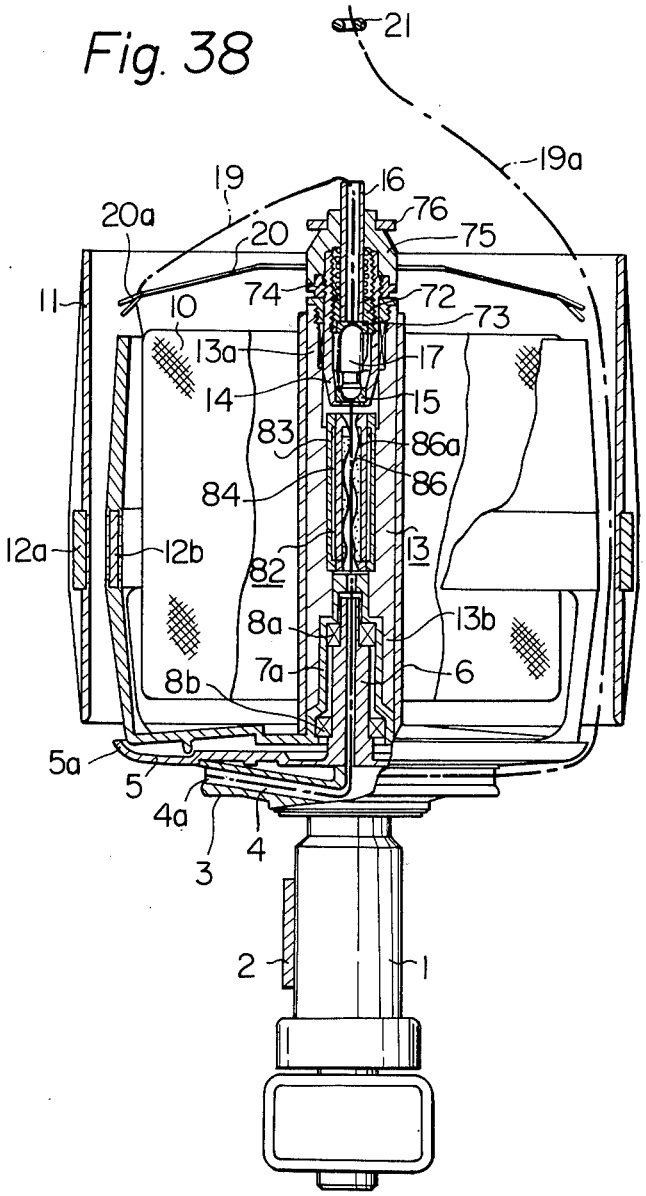
FIG. 38 is a view in axial section through a double twister, which is a modification of the double twister shown in FIG. 34.

The double twister shown in FIG. 38 is a modification of the double twister shown in FIG. 33. In this double twister, the feed bushing 13 is further provided with an oiling function in addition to the function of twisting-in the fuzzy fibers into the main body of the yarn 19. Since the main mechanism of this double twister is similar to the double twister shown in FIG. 33, identical reference numerals are used for elements which are similar to the elements of the double twister shown in FIG. 33, and the explanation concerning these elements is omitted. Consequently, the following explanation is directed toward the construction and function of the feed bushing 13.

Figure 39:
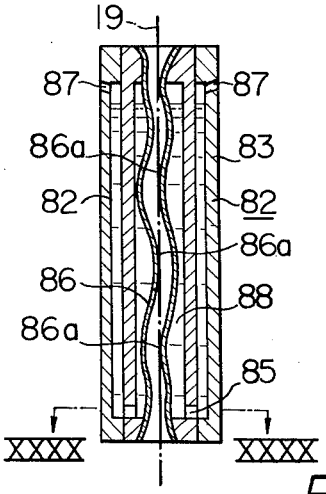
FIGS. 39, 41, 42 and 43 are cross-sectional views of oiling devices, provided with a contacting member, applied for the double twister shown in FIG. 38.
Figure 40:
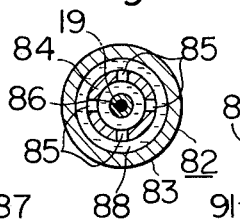
FIG. 40 is a cross-sectional view of the oiling device, taken along the line XXXX — XXXX in FIG. 39.

Referring to FIGS. 38, 39 and 40, an oiling bath 82 is detachably disposed in the feed bushing 13, and the oiling bath 82 is composed of an outside bath 83 made of a transparent material and an inside bath 84 disposed in the outside bath 83. The outside bath 83 is connected to the inside bath 84 via a plurality of connecting apertures 85 formed at a bottom wall portion of the inside bath 84. A meandering yarn guide member 86 made of a porous material is disposed in the inside bath 84 so as to form a yarn passage. The function of this meandering yarn guide member 86 is quite similar to the contacting member 24 shown in FIG. 22, except that oil which moves into the yarn passage through the porous material of the yarn guide member 86 works is additionally promote the twisting-in of the fuzzy fibers into the main body of the yarn 19 when the yarn 19 contacts the inside surfaces 86*a* of the meandering yarn guide member 86. The outside bath 83 is provided with a plurality of inlet aperture 87 for supplying oil thereinto. Since the yarn surface of the yarn 19 is provided with oil, the creation of fuzzy fibers, when the yarn passes over the peripheral surface of the reserve disc 3 and the edge 5*a* of the deflection plate 5, is effectively controlled. Creation of static electricity when the yarn 19 is rubbed is also effectively prevented by the above-mentioned oiling.

When it is required to change the oiling device in the above-mentioned double twister, the tension mechanism comprising the tenser container 14 and capsule 17, the entry tube 16 and flyers are taken from the feed bushing 13, and then the oiling device can be exchanged.

Figure 41:
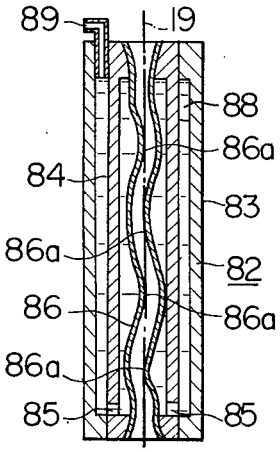
Figure 42:
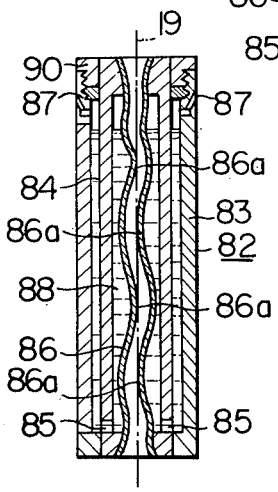
Figure 43:
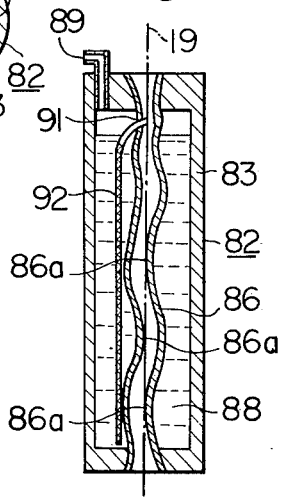

In the oiling device shown in FIGS. 41, 42 and 43, several modifications are applied. That is, in the oiling device shown in FIG. 41, an oil supply pipe 89 is provided instead of the aperture 87. In the oiling device shown in FIG. 42, a cover 90 is disposed on the opened top of the oiling device so that the supplying of oil 88 can be easily carried out. In the oiling device shown in FIG. 43; the inside oil bath 84 in the embodiment shown in FIG. 41 is omitted; the yarn guide member 86 is made of a solid material such as a plastic or iron; a plurality of small apertures 91 are formed in the wall of the yarn guide member 86, and; a piece of fabric 92 (guaze) or sponge rubber is inserted into each aperture 91 in such a condition that a bottom portion of the fabric or sponge rubber 92 is immersed into the oil 88 of the oil bath 83. As mentioned above, the oiling device applied to the feed bushing 13 has a simple construction and can be made compact, and consequently, such oiling device provides a very practical advantage to the double twister.

Many different modifications can be applied to the double twister according to the present invention in the spirit of the present invention. It is also noted that further modification of the device embodied in the double twister can be effected, such as:

a. any material can be utilized for making the device of the present invention if the above-mentioned function for twisting-in the fuzzy fibers into the main body of the supplied yarn is realized;

b. any surface treatment may be applied for the contacting surface of the device according to the invention, if the above-mentioned function for twisting-in the fuzzy fibers into the main body of the supplied yarn is realized;

c. the contacting member shown in FIGS. 4 through 23 can be utilized instead of the conventional snail wire disposed above the entry tube of the double twister;

d. the contacting member shown in FIGS. 4 through 23 can be utilized to attain the purpose of the present invention in such a condition that the contacting member is disposed along the yarn passage at a position adjacently upstream or downstream of the conventional snail wire disposed above the entry tube of the conventional double twister.

What is claimed is:

1. In a twisting operation applied to a yarn by means of a multiple twister provided with at least two yarn twisting zones arranged successively, said yarn being supplied from a yarn package disposed in said multiple twister, a method for eliminating fuzzy fibers on the surface of a twisted yarn comprising:

a. mechanically laying down fuzzy fibers projecting from a main body of said yarn along said main body, while twisting said yarn in at least one of said twisting yarn zones and;

b. twisting-in said laying down fuzzy fibers into said main body of yarn by said twisting operation.

2. Method for preventing creation of fuzzy fibers on the surface of a twisted yarn according to claim 1, wherein said laying down of said fuzzy fibers in said first twisting zones is concentrated at an upstream terminal portion of said first twisting zones, while said laying down of said fuzzy fibers in a second of said two twisting zones is concentrated at a downstream terminal portion of said second yarn twisting zone.

3. Method for preventing creation of fuzzy fibers on the surface of a twisted yarn according to claim 1, further comprising (c) originating an unwinding twist created by takingup said yarn from said yarn package at an upstream terminal of a first of said twisting yarn zones.

4. Method for eliminating the presence of fuzzy fibers on the surface of a twisted yarn according to claim 1, further comprising (d) oiling said yarn when said yarn is passing through an upstream terminal portion of said first twisting zone where said yarn is laid down.

5. In a multiple twister provided with at least a first twisting zone and a second twisting zone successively arranged, a disc for reserving yarn on the peripheral surface thereof, means for introducing a yarn into said first twisting zone, said first twisting zone defined by a spindle provided with a hollow yarn passage coaxially arranged at a position below said yarn introducing means, said second twisting zone defined by said reserve disc rigidly mounted on said spindle and a yarn guide member disposed at a position above said yarn introducing means, said second twisting zone of said reserve disc being connected to a bottom of said hollow yarn passage of said spindle and provided with an outlet opening formed at an outer edge of said reserve dics, a device for eliminating the presence of fuzzy fibers of yarn during a twisting operation comprising, in combination, means for imparting tension to said yarn introduced into said yarn introducing means at a position upstream of said spindle, means for stroking fuzzy fibers projecting from a main body of said yarn against said main body while said yarn in said first twisting zone at a downstream position thereof with said tension imparting means, and second means for stroking fuzzy fibers projecting from a main body of a first twisted yarn delivered from said first twisting zone in said second twisting zone.

6. Device for eliminating the presence of fuzzy fibers of yarn during a twisting operation by a multiple twister according to claim 5, wherein said first means for stroking fuzzy fibers against said main body of yarn is a feed bushing coaxially disposed at a position between said tensioning means and said spindle, said feed bushing being provided with a yarn passage formed therein wherein said yarn passage is connected to a bottom aperture of said tensioning means and a top entrance of said hollow yarn passage of said spindle, said yarn passage being provided with a contacting member which strokes said fuzzy fibers against said main body without disturbing the turning motion of said yarn around the longitudinal axis of said yarn.

7. Device for eliminating the presence of fuzzy fibers of yarn during a twisting operation by a multiple twister according to claim 6, wherein said contacting member is provided with a least one friction surface member having low frictional resistance, said friction surface member is provided with at least one projecting portion which contacts said yarn.

8. Device for eliminating the presence of fuzzy fibers of yarn during a twisting operation by a multiple twister according to claim 6, wherein said contacting member is provided with a friction surface member having positionally adjustable projecting portions.

9. Device for eliminating the presence of fuzzy fibers of yarn during a twisting operation by a multiple twister according to claim 7, wherein said contacting member is provided with a plurality of friction surface members arranged along a yarn passage in said feed bushing and said friction surface members contact said yarn from different transversal directions with respect to the running direction of said yarn.

10. Device for eliminating the presence of fuzzy fibers of yarn during a twisting operation by a multiple twister according to claim 7, wherein said contacting member is provided with a plurality of friction surface members arranged along a yarn passage in said feed busing and said friction surface members contact said yarn from two opposite transversal directions with respect to the running direction of said yarn.

11. Device for eliminating the presence of fuzzy fibers of yarn during a twisting operation by a multiple twister, according to claim 6, wherein said tensioning means is rotatably mounted to freely turn together with said flyer and said entry tube against said feed bushing.

12. Device for eliminating the presence of fuzzy fibers of yarn during a twisting operation by a multiple twister according to claim 6, wherein said contacting member is connected to an oiling bath disposed in said feed bushing.

13. Device for eliminating the presence of fuzzy fibers of yarn during a twisting operation by a multiple twister according to claim 12, wherein said contacting member is provided with at least one friction surface member made of porous materials which permits passage of oil from said oiling bath into said yarn passage.

14. Device for eliminating the presence of fuzzy fibers of yarn during a twisting operation by a multiple twister according to claim 5, wherein said second means for stroking fuzzy fibers against said main body of said first twisted yarn is formed in said yarn guide disposed above said yarn introducing means said yarn guide is composed of a conical inlet portion and a cylindrical portion connected to said conical inlet portion, at least one of said conical inlet portion and said cylindrical portion being provided with a friction surface having a frictional resistance to said yarn which is sufficient to stroke said fuzzy fibers against said main body of said first twisted yarn without disturbing the turning motion of said first twisted yarn.

15. Device for eliminating the presence of fuzzy fibers of yarn during a twisting operation by a multiple twister according to claim 14, wherein said conical portion and said cylindrical portion of said yarn guide are provided with a plurality of small apertures.

16. Device for eliminating the presence of fuzzy fibers of yarn during twisting operation by a multiple twister according to claim 15, wherein said yarn guide is disposed in a suction box in such a way that an inlet of said conical portion and an outlet of said cylindrical portion are projected outside from said suction box and said suction box is connected to a suction source.

17. Device for eliminating the presence of fuzzy fibers of yarn during a twisting operation by a multiple twister according to claim 5, wherein said second means for stroking fuzzy fibers against said main body of said first twisted yarn is formed in said yarn guide disposed above said yarn introducing means, said yarn guide is provided with a substantially spherical chamber having an inlet aperture and an outlet aperture; a friction ball is rotatably held in said chamber, whereby said first twisted yarn contacts an edge of said inlet aperture and then contacts said first friction ball when said first twisted yarn passes through said yarn guide.

18. Device for eliminating the presence of fuzzy fibers of yarn during a twisting operation by a multiple twister according to claim 5, wherein said tensioning means comprises adjustable means to change yarn tension.

* * * * *